US006669500B1

(12) United States Patent
Ju

(10) Patent No.: US 6,669,500 B1
(45) Date of Patent: Dec. 30, 2003

(54) CENTRAL PROCESSING UNIT SOCKET ASSEMBLY

(75) Inventor: Ted Ju, Taipei (TW)

(73) Assignee: Chia Tse Terminal Industry Co., Ltd., Keelung (TW)

( * ) Notice: Subject to any disclaimer, the term of this patent is extended or adjusted under 35 U.S.C. 154(b) by 0 days.

(21) Appl. No.: 10/209,883

(22) Filed: Aug. 2, 2002

(51) Int. Cl.[7] ..... H01R 13/625
(52) U.S. Cl. ..... 439/342; 439/259
(58) Field of Search ..... 439/342, 259, 439/263, 265, 266, 268

(56) References Cited

U.S. PATENT DOCUMENTS 6,071,140 A * 6/2000 McHugh et al. ..... 439/342
6,231,366 B1 * 5/2001 Pei et al. ..... 439/342
6,338,640 B1 * 1/2002 Lin ..... 439/342
6,450,825 B1 * 9/2002 Huang ..... 439/342
6,450,827 B1 * 9/2002 Huang et al. ..... 439/342

* cited by examiner

*Primary Examiner*—Hien Vu

(74) *Attorney, Agent, or Firm*—Leong C. Lei

(57) ABSTRACT

In an improved CPU base cover turning component, a CPU socket thereof includes a CPU socket base, CPU base cover, and a CPU base cover turning component. One lateral end of the CPU base cover projects to form an extension cover block, one lateral end of the CPU socket base projecting to form an extension base block, fasten walls capable of surrounding and clamping two sides of the CPU socket base extending vertically from two sides of the CPU base cover to clamp and surround the CPU socket base, the extension cover block fastening and covering the extension base block, the CPU base cover turning component being sandwiched between the extension cover block of the CPU base cover and the extension base block of the CPU socket base. The CPU base cover turning component specifically includes a rotary shaft with a middle section projecting to form an eccentric collar, and a top frame urged by the collar, shaft holes being respectively formed in the extension cover block and the extension base block in a vertical direction in corresponding suitable positions for insertion of two shaft ends of the rotary shaft, cover surface of the extension cover which overlaps the extension base block being formed with a recess with a shape that can retain the top frame tightly, an insert hole being formed in the center of the shaft end of the rotary shaft that extends through the extension cover block.

3 Claims, 4 Drawing Sheets

CENTRAL PROCESSING UNIT SOCKET ASSEMBLY

BACKGROUND OF THE INVENTION

The quality of Central Processing Units (CPU) has a direct effect on the operational speed of computers and their operational performance. Unlike Integrated Circuit (IC) sockets, which are used to insert an IC in conventional circuit boards, the CPU sockets provided on main boards to insert a CPU require a tighter locking operation or have more release pins than the conventional IC socket in order to ensure the CPU can function normally. Therefore, the role of the CPU socket is very important.

A conventional CPU socket structure generally includes a CPU socket base, a CPU base cover, and a CPU base cover turning component. By means of turning the CPU base cover, the pin holes of the CPU base cover and pin holes of the CPU socket base can be aligned or staggered at a certain distance to clamp or release CPU pins to permit connection or removal of the CPU. In the CPU base cover turning component, one end of an L-shaped wrench is inserted transversely into a gap between the CPU base cover and CPU socket, with the other end placed horizontally near the CPU socket. When the removal or restoring of the CPU base cover is required, the wrench has to be turned to move the CPU base cover, which results in the following disadvantages:

1. Since the L-shaped wrench is disposed to one side of the CPU socket, it occupies the space around the CPU socket so that a space has to be reserved on the circuit board on which the CPU socket is to be mounted near the position of the CPU socket for accommodating the L-shaped wrench. At that position, it is not possible to arrange electronic parts close to the CPU socket, and it is not possible to reduce the size of the circuit board.

2. The L-shaped wrench disposed near the CPU socket can be manipulated and removed by anyone, which affects the connection of the CPU pins and CPU socket, and mounting or detachment of the CPU is better performed by technicians to prevent damage to the CPU. However, since the L-shaped wrench used to turn the CPU base cover can be manipulated even by children, this may result in the exposure of the CPU, the CPU socket maintenance circuits, and the CPU base cover being inadvertently touched by people who are not technicians, resulting in damage to the CPU.

SUMMARY OF THE INVENTION

Therefore, the object of the invention is to provide an improved CPU socket assembly. The turning component is provided between an extension cover block of a CPU base cover and an extension base block of a CPU socket base so that there is no need to dispose a structural element that will take up space near the CPU socket and so electronic parts can be tightly packed near the CPU socket. Hence, a circuit board having the CPU socket mounted on its surface can be reduced in size to facilitate the manufacture of smaller electrical appliances.

Another object of the invention is to provide an improved CPU base cover turning component which has a rotary shaft requiring turning in order to move the CPU base cover. The center of the shaft end of the rotary shaft extending through the CPU cover block is provided with an insert hole. When it is desired to move the CPU base cover, a suitable tool has to be used to extend into the insert hole via a shaft hole in the extension cover and turned in order to urge the CPU base cover to clamp or release CPU pins inserted into the CPU socket so that persons other than technicians cannot handle or remove the CPU base cover, thereby preventing inadvertent turning of the CPU base cover and protecting the CPU.

DETAILED DESCRIPTION OF THE PREFERRED EMBODIMENT

Figure 1:
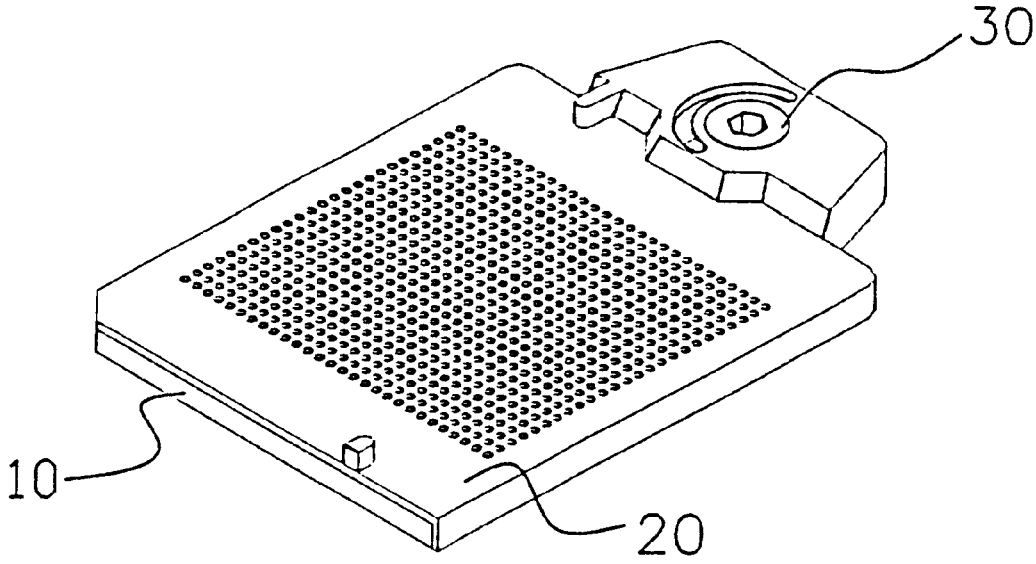
FIG. 1 is a perspective view of the improved CPU base cover turning component of the invention.
Figure 2:
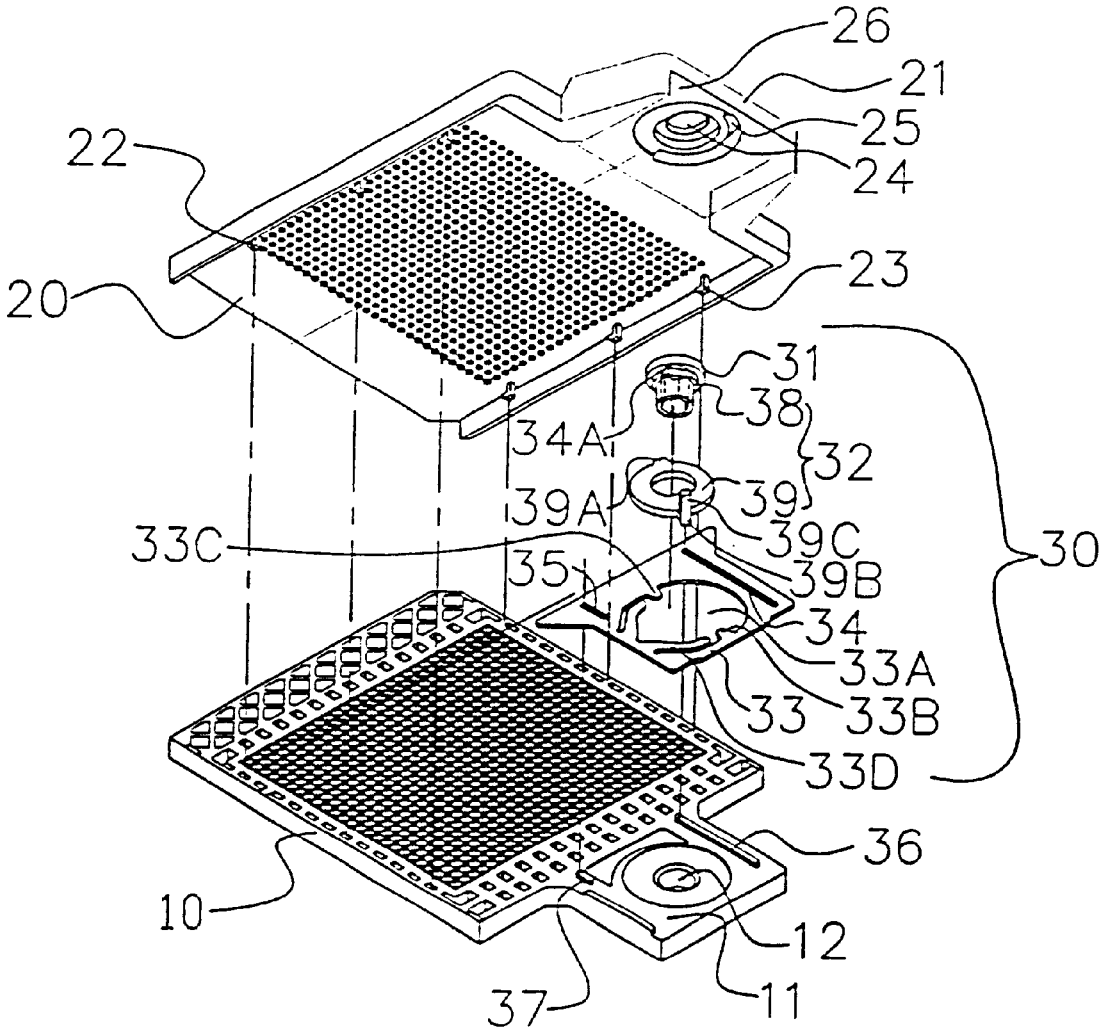
FIG. 2 is an exploded perspective of the improved CPU base cover turning component of the invention.

Referring to FIG. 1, which is a perspective view of an improved CPU socket assembly of the invention, and referring also to FIG. 2, which is an exploded perspective view, it can be seen that in the improved CPU socket assembly of this invention, the entire CPU socket includes a CPU socket base 10, a CPU base cover 20, and a CPU base cover turning component 30. One lateral end of the CPU base cover 20 projects to form an extension cover block 21. One lateral end of CPU socket base 10 projects to form an extension base block 11. The walls 22, 23 are capable of surrounding and clamping two sides of the CPU socket base 10 by means of hooks, and extend vertically from two sides of the CPU base cover 20 to clamp and surround CPU socket base 10. The extension cover block 21 fastens and covers extension base block 11. The CPU base cover turning component 30 is sandwiched between extension cover block 21 of CPU base cover 20 and extension base block 11 of CPU socket base 10. The CPU base cover turning component 30 specifically includes a rotary shaft 31 with a circular portion projecting from its center to form an eccentric collar 32, and a top frame 33 engaged by the collar 32. Shaft holes 24, 12 are respectively formed in extension cover block 21 and extension base block 11 in a vertical direction in corresponding suitable positions for insertion of two shaft ends of rotary shaft 31 to connect the rotary shaft 31 with the extension base block 21 and the extension cover block 11. Additionally, an insert hole 34A is formed in the center of the shaft end of rotary shaft 31 that extends through extension cover block 21. The structure of the middle section of rotary shaft 31 which forms eccentric collar 32, as shown in the exploded perspective view, can be an annular block 38 with a cut edge formed on the middle section of rotary shaft 31 itself, with a flat cam 39 tightly fitted around annular block 38. Cam 39 may have projections 39A, 39B respectively extending from the edges farthest from and nearest to the cam center. Projection 39B extends vertically toward extension cover block 21 to form an indicator rod 39C. Extension cover block 21 is formed with a curved through hole 25 corresponding to indicator rod 39C. The cover surface of extension cover 21 which overlaps extension base block 11 is formed with a recess 26 configured to receive and retain top frame 33 tightly. Additionally, long slide grooves 34, 35 extending in the same direction as the direction of movement of CPU base cover 20 are formed at suitable positions of top frame 33. The base surface of extension base block 11 which overlaps extension cover block 21 and which corresponds to long slide grooves 34, 35 is provided with rail blocks 36, 37 of a length shorter than long slide grooves 34, 35. These rail blocks 36, 37 have a width such that they can pass precisely through corresponding long slide grooves 34, 35 so that when top frame 33 is displaced, the CPU base cover 20 is guided to turn in a fixed direction by means of the long slide grooves 34, 35 that have to slide longitudinally along length of rail blocks 36, 37, and frame hole 33A of the top frame 30 is positioned to receive flat cam 39. The edges of the hole 33A which correspond to two ends of top frame 33 respectively project inward to form stop blocks 33B, 33C. Stop blocks 33B, 33C can prevent the lateral edges of projections 39A, 39B extending any further from flat cam 39. A curved outwardly extending fork 33D projects integrally from one lateral edge of the frame hole 33A toward two ends of the hole.

Figure 3:
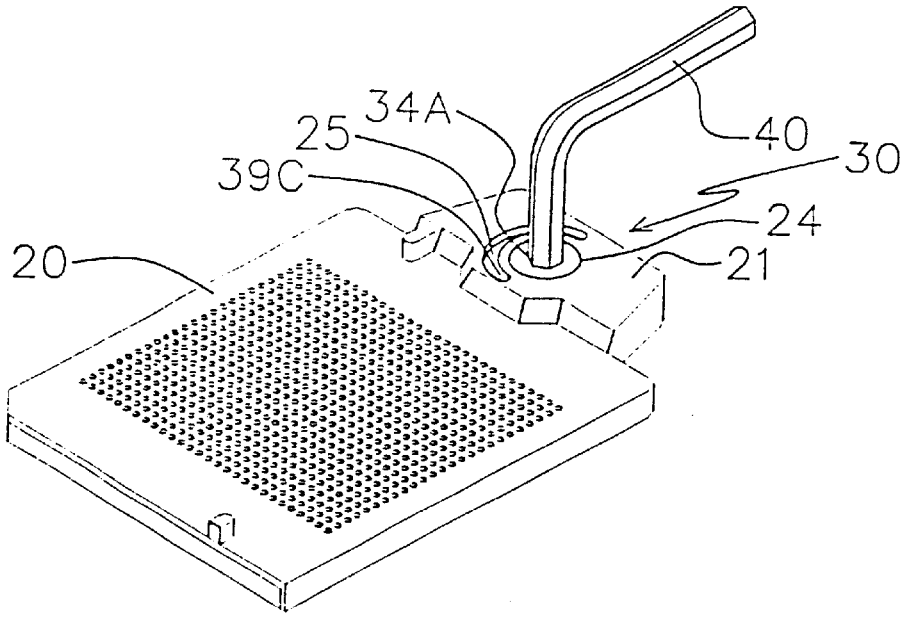
FIG. 3 is a schematic view illustrating operation of the improved CPU base cover turning component of the invention.
Figure 4:
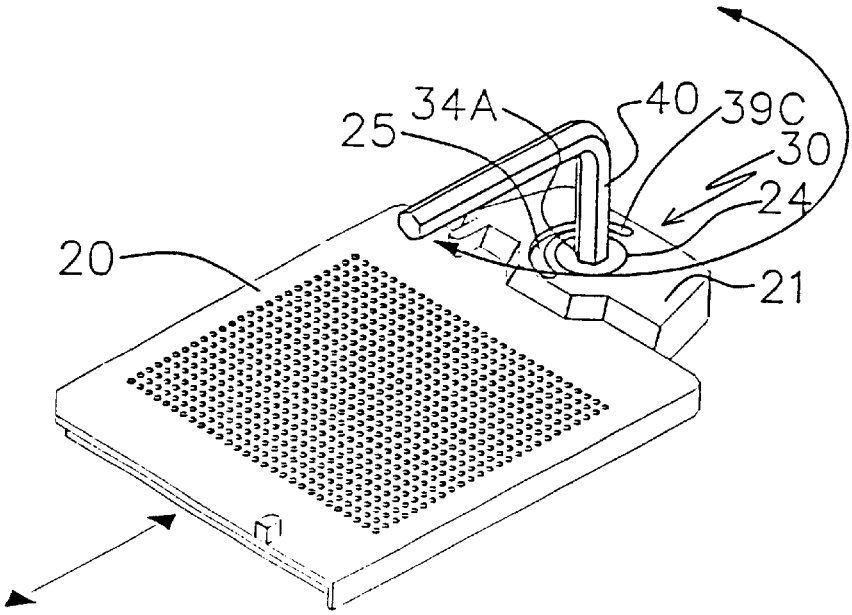
FIG. 4 is another schematic view illustrating operation of the improved CPU base cover turning component of the invention.
Figure 5:
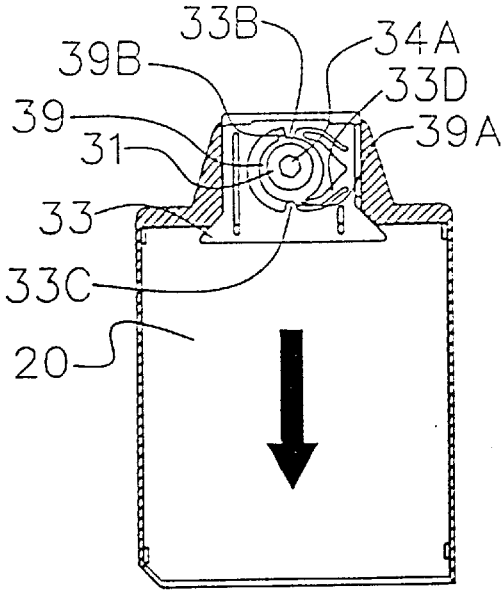
FIG. 5 is a schematic view of the improved CPU base cover turning component of the invention, showing outward movement of the CPU base cover.
Figure 6:
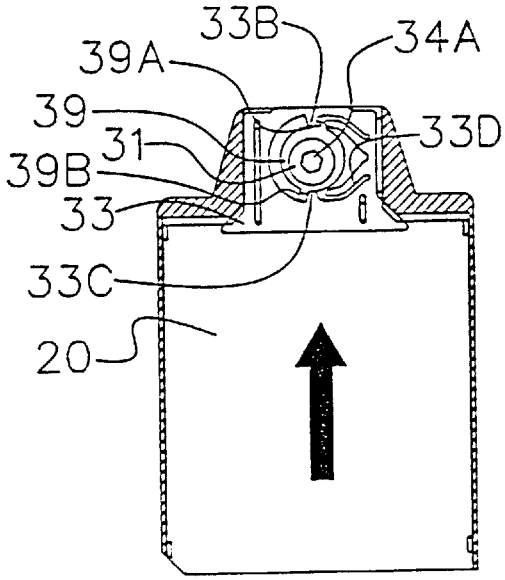
FIG. 6 is a schematic view of the improved CPU base cover turning component of the invention, showing inward movement of the CPU base cover.

Based on this construction, when CPU base cover 20 is moved, as shown in FIGS. 3 and 4, a suitable tool 40 is inserted via shaft hole 24 of extension cover block 21 into insert hole 34A and turned. By observing the position of indicator rod 39C in curved through hole 25, it can be determined whether or not the suitable tool 40 being used has turned the CPU base cover turning component 30 to the other end, and that, as shown in FIGS. 5 and 6, the rotary rod 31 which is turned has brought flat cam 39 to urge top frame 33, which synchronously pushes CPU base cover 20, and when turned to the utmost end, as shown in the figures, these projections 39A, 39B are stopped by stop blocks 33B, 33C. During the process of turning, these projections 39A, 39B produce a buffering effect to prevent violent turning damage due to the elasticity of the material of the fork member 33D, so that the CPU base cover 30 clamps or releases the CPU pins to be inserted into the CPU socket, thereby preventing inadvertent turning of CPU base cover 20. The invention has the effect of occupying less space compared to the conventional CPU base cover turning component.

Although the present invention has been illustrated and described with reference to the preferred embodiment thereof, it should be understood that it is in no way limited to the details of such embodiment but is capable of numerous modifications within the scope of the appended claims.

What is claimed is:

1. A CPU socket assembly comprising: a CPU socket base, CPU base cover, and a CPU base cover turning component, wherein one lateral end of said CPU base cover projects to form an extension cover block, one lateral end of said CPU socket base projecting to form an extension base block, said CPU base cover having walls provided with means surrounding and clamping two sides of said CPU socket base, said extension cover block fastening and covering said extension base block, said CPU base cover turning component being sandwiched between said extension cover block of said CPU base cover and said extension base block of said CPU socket base, said CPU base cover turning component including a rotary shaft with a circular portion projecting from a center to form an eccentric collar, and a top frame engaged by said collar, shaft holes being respectively formed in said extension cover block and said extension base block for insertion of two shaft ends of said rotary shaft, cover surface of said extension cover which overlaps said extension base block being formed with a recess configured to receive and retain said top frame tightly, said eccentric collar being an annular block with a cut edge formed on an intermediate section of said rotary shaft, a flat cam tightly around said eccentric collar, said flat cam having projections respectively extending from edges farthest from and nearest to a center of said flat cam, one of said projections extending toward said extension cover block to form an indicator rod, said extension cover block being formed with a curved through hole for receiving said indicator rod.

2. The CPU socket assembly as claimed in claim 1, wherein slide grooves extending in the same direction as the direction of movement of said CPU base cover are formed on said top frame, base surface of said extension base block which overlaps said extension cover block and which corresponds to said slide grooves being provided with rail blocks of a length shorter than said slide grooves, said rail blocks being engaged with said slide grooves so that when said top frame displaces, the CPU base cover is guided to turn in a fixed direction by means of said slide grooves.

3. The CPU socket assembly as claimed in claim 1, wherein a curved outwardly extending fork projects integrally from one lateral edge of a hole of said top frame.

* * * * *